United States Patent [19]

Lobb

[11] Patent Number: 4,837,829

[45] Date of Patent: Jun. 6, 1989

[54] ACOUSTIC SOUND SYSTEM FOR A ROOM

[75] Inventor: William E. Lobb, Wallingford, Conn.

[73] Assignee: Jaffe Acoustics, Inc., Norwalk, Conn.

[21] Appl. No.: 106,936

[22] Filed: Oct. 8, 1987

Related U.S. Application Data

[63] Continuation of Ser. No. 818,903, Jan. 15, 1986, abandoned, which is a continuation of Ser. No. 681,691, Dec. 14, 1984, abandoned, which is a continuation of Ser. No. 407,845, Aug. 13, 1982, abandoned.

[51] Int. Cl.[4] ..... H04R 3/00; H04R 27/00

[52] U.S. Cl. ..... 381/83

[58] Field of Search ..... 379/202, 206, 388, 389, 379/420; 381/82, 83, 93, 94

[56] References Cited

U.S. PATENT DOCUMENTS

| | | | |
|---|---|---|---|
| 2,177,769 | 10/1939 | Erickson | 381/93 X |
| 3,256,391 | 6/1966 | Boner | 381/93 |
| 3,922,488 | 11/1975 | Gabr | 381/43 X |
| 3,992,586 | 11/1976 | Jaffe | 381/83 |
| 4,088,835 | 5/1978 | Thurmond et al. | 381/83 |
| 4,184,048 | 1/1980 | Alcaide | 381/83 |
| 4,485,272 | 11/1984 | Duong et al. | 381/93 X |

FOREIGN PATENT DOCUMENTS 61812 10/1982 European Pat. Off. .

OTHER PUBLICATIONS

A Sound Reinforcement System for Multiple Conference Rooms, from the Journal of the Audio Engineering Society, 1969, by: Melvin S. Draper, Seattle, Washington, pp. 184–196.

Microphones Electrically Out of Phase, from Microphones: Design and Application, by: Burroughs, Sagamore Pub. Co., Plainview, New York, 1974, pp. 99–108.

*Primary Examiner*—Keith E. George

*Attorney, Agent, or Firm*—Peter D. Aufrichtig

[57] ABSTRACT

A modular acoustic sound system for a room for two-way conversations without the need for switching. The system includes pairs of microphones each connected to a phase shifter so that in-phase signals inputted to the microphone pair are shifted 180° apart. The out-of-phase signals are input to a summing circuit having an amplified output which drives a plurality of loudspeakers. A portion of the audible loudspeaker outputs enters the microphone pair, is phase shifted, and cancelled out in the summing amplifier. Any number of loudspeaker/-microphone pairs operate in the system and any microphone may be spoken into to drive every loudspeaker.

12 Claims, 3 Drawing Sheets

ACOUSTIC SOUND SYSTEM FOR A ROOM

This is a continuation of application Ser. No. 06/818,903 filed Jan. 15, 1986 now abandoned, which is a continuation of application Ser. No. 06/681,691 filed Dec. 14, 1984 now abandoned, which is a continuation of application Ser. No. 06/407,845 filed Aug. 13, 1982 now abandoned.

BACKGROUND OF THE INVENTION

This invention relates generally to an acoustic sound system of the type permitting communication between two or more separated parties, and more particularly to an acoustic sound system where all parties may speak freely without distortion or need for switching. In acoustic systems of the prior art having a plurality of microphone inputs and loudspeaker outputs, it is necessary at a terminal including a microphone and a loudspeaker to turn the microphone off when a signal is being received on a loudspeaker. Conversely, the loudspeaker is turned off when the person speaks into the microphone. This complicates procedures of two-way communication and represents an inconvenience. Other prior art systems are turned on by voice power and turn off when the person ceases to speak. These systems suffer from clipping of speech generally at the initiation and termination thereof.

What is needed is an acoustic sound system which operates on a hand-free basis and requires no switching which can clip and distort the speech.

SUMMARY OF THE INVENTION

Generally speaking, in accordance with the invention, an acoustic sound system especially suitable for two-way conversations without the need for switching is provided. The acoustic sound system includes pairs of microphones each connected individually to a phase shifter so that in-phase signals inputted to the microphone pair are shifted 180° apart. The out-of-phase signals are then input to a summing circuit having an amplified output which drives with equal power a plurality of loudspeakers. A portion of the audible loudspeaker outputs enters the microphone pair, is phase shifted, and cancelled out in the summing amplifier. Any number of loudspeaker/microphone pairs operate in the acoustic sound system and any microphone may be spoken into to drive every loudspeaker without switching.

Alternatively, the outputs of a pair of loudspeakers may be out of phase and the microphone pickup signals are transmitted directly to the summing amplifier without further phase shift.

Accordingly, it is an object of this invention to provide an improved acoustic sound system permitting communication between a plurality of loudspeaker/microphone terminals without switching.

Another object of this invention is to provide an improved acoustic sound system having a plurality of loudspeakers having equal amplitude output.

A further object of this invention is to provide an improved acoustic sound system which provides two-way communication without distortion and clipping of the speech at initiation and termination thereof.

Yet another object of the invention is to provide an improved acoustic sound system which cancels unwanted microphone inputs while outputting wanted signals.

Still other objects and advantages of the invention will in part be obvious and will in part be apparent from the specification.

The invention accordingly comprises the features of construction, combination of elements, and arrangement of parts which will be exemplifed in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
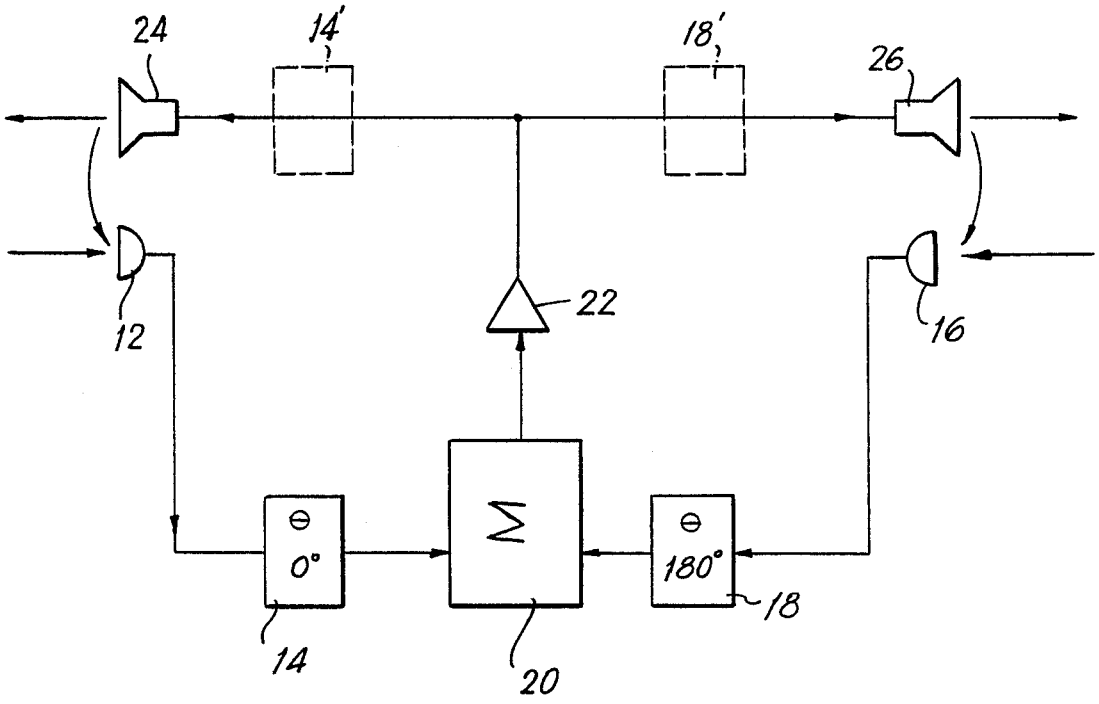
FIG. 1 is a functional schematic of an acoustic sound system in accordance with the invention.
Figure 2:
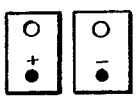
FIG. 2 is a pair of modular units for use in the acoustic sound system in FIG. 1.

With reference to FIG. 1, an acoustic sound system in accordance with the invention includes a microphone 12 connected to a phase shifter 14. A second microphone 16 connects to a second phase shifter 18 and the two phase shifters are connected to a summing circuit 20. The output of the summing circuit 20 is input to an amplifier 22 having an output connected to a first loudspeaker 24 associated with the microphone 12 and to a second loudspeaker 26 associated with the microphone 16. The geometric mounting of the microphone 12 and loudspeaker 24 is similar to the mounting of the microphone 16 and loudspeaker 26 to the greatest practical extent. For example, associated microphones and loudspeakers may be mounted in a housing or modular unit (FIG. 2) which is similar in construction and dimensions to the construction of the other microphone and loudspeaker. Desirably, all microphone/loudspeaker combinations or modules are acoustically matched one combination to the other.

In operation, when a person speaks into a microphone, for example, the microphone 12, the signal passes through the phase shifter 14 and the summing circuit 20. The output of the summing circuit 20 is amplified by the amplifier 22. Both loudspeakers 24, 26 are driven by the output of the amplifier 22 and provide an inphase acoustic, that is, sonic output in the audible range. The audible output from each loudspeaker 24, 26 is equal in amplitude and is heard by anyone within earshot of the loudspeaker. The loudspeakers 24, 26 may be in the same or in different rooms.

In addition to the audible loudspeaker outputs being available for hearing by persons or sensing by instruments, a portion of the acoustic energy from the loudspeaker 24 enters the microphone 12 and an equal portion of the acoustic output of the loudspeaker 26 enters the microphone 16. As stated, the components are physically oriented for equal microphone inputs. The input to the microphone 12 passes through the phase shifter 14 as described above, and the signal from the microphone 16 passes through the phase shifter 18 and enters the summing circuit 20. The phase shifters 14, 18 shift the signals such that the two independent signals entering the summing circuit 20 are equal in amplitude but 180° out of phase. In the summing circuit 20, the two equal but out-of-phase signals cancel, and as a result, no signal is outputted from the summing circuit 20 amplifier 22 and loudspeakers 24, 26 as a result of the original sound from the loudspeakers 24, 26 entering the associated microphones 12, 16, respectively.

If, on the other hand, a person speaks into the microphone 16, the voice is outputted by both loudspeakers 24, 26 to be heard by anyone in the vicinity of either loudspeaker. This results because the input from the microphone 16 is not cancelled in the summing circuit 20 by any equal and out-of-phase signal. Also, a portion of the audible output from the loudspeakers 24, 26 enters the associated microphones 12, 16, respectively and is cancelled in the summing circuit 20 after phase shifting by the shifters 14, 18, as described above. Either microphone 12, 16 can be spoken into without the need for any form of switching circuit for the purpose of isolating one microphone and loudspeaker when the other microphone is being used.

Further, both microphones 12, 16, can be spoken into concurrently by two persons at separate locations and both inputs will be simultaneously outputted from loudspeakers 24, 26. A portion of both signals is fedback through the associated microphones and is cancelled as a result of phase shifting and the summing circuit 20. Thus, both microphones and loudspeakers can be used simultaneously, regardless of any difficulty and confusion in speech comprehension which may result, without need for switching circuits and without regeneration of signals which might otherwise cause howling from the loudspeakers.

Further, the summing circuit 20 and amplifier 22 can receive inputs from any number of modular units (FIG. 2) including a loudspeaker and microphone so long as there is an equal number of modular units and every input from the speaker to the microphone of a modular unit to the summing circuit 20 is accompanied by an equal input from another modular unit 180° out of phase. As previously stated, each pair of modular units should provide the same physical, acoustic relationships between the microphone and loudspeaker and to the greatest possible extent should be in similar acoustic environments. All transducers, amplifiers, wiring impedances, distance relationships and environmental conditions should be matched for best balance.

The degree to which cancellation can be achieved is not the subject of the invention but it should be understood that the invention can be usefully applied if any significant degree of cancellation is obtained. This is a system for the transmission and/or amplification of signals, in which either the transmitted signals or the received signals are summed differentially so that desirably the net sidetone, or crosstalk, from the receivers to the transmitters is zero. In this way, desired signals are transmitted, while undesired signals are rejected.

In an alternative embodiment of an acoustic sound system in accordance with the invention, the phase shifters 14, 18 are not positioned in the circuit (FIG. 1) as indicated in solid lines, but phase shifters 14', 18', indicated with broken lines, are positioned between the loudspeakers 24, 26 and the amplifier 22, respectively. In such an embodiment, outputs of the loudspeakers 24, 26 are equal in amplitude but caused to be 180° out of phase. Thus, inputs from the loudspeakers 24, 26 to the microphones 12, 16, respectively, are equal in amplitude and 180° out of phase. As before, these out-of-phase signals cancel in the summing circuit 20.

Many types of circuits are suitable as phase shifters 14, 18. For example, the phase shifters may include an amplifier for signal inversion, or transformers. The summing circuit 20 may be an operational summing amplifier. Since microphones and loudspeakers are two-terminal devices, their polarities can be reversed where necessary to obtain phase reversal for cancellation purposes and a "phase shifter" per se is not required.

In summary, the number of loudspeakers and microphones in the system is only limited by the ability to drive a large number of loudspeakers simultaneously. The microphones, no matter how many, receive the same unwanted signal from the loudspeaker, and this signal is cancelled as a result of the phase shifting and summing functions. Only the desired signal, that is, the person speaking, is outputted at every loudspeaker because only one microphone is originally inputted with the voice signal and there is no cancellation within the circuitry of the acoustic sound system in accordance with the invention. Accurate construction assures that acoustic relationships between the microphone and loudspeaker correspond accurately among the units as stated above.

Figure 4:
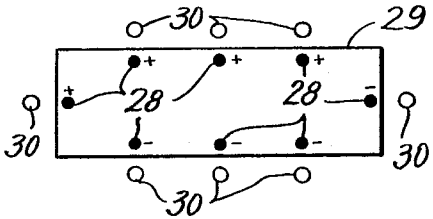
FIG. 4 is a top view of a conference table using an acoustic sound system in accordance with FIGS. 1 and 3.

FIG. 4 illustrates a practical application of an acoustic sound system in accordance with the invention. The application is a boardroom of extended length where a large number of persons participate simultaneously at a meeting or conference. Modular units (FIG. 2) comprising a loudspeaker 30 and microphone 28 are positioned around a table 29, for example, suspended from the ceiling above the seating positions where sound pickup and output are desired. As illustrated in FIG. 4, a symmetrical arrangement is provided such that every microphone and loudspeaker module is symmetrically related to another microphone and loudspeaker which will provide an out-of-phase signal to the circuits as described above. A + sign indicates all microphones which provide signals of the same phase relationship to the summing amplifier, and a sign indicates all microphones providing the out-of-phase signal. Thus, in FIG. 4, every modular unit is opposed by another modular unit across the width or length of the table such that there is mirror symmetry from side to side of the table as well as end to end.

Figure 3:
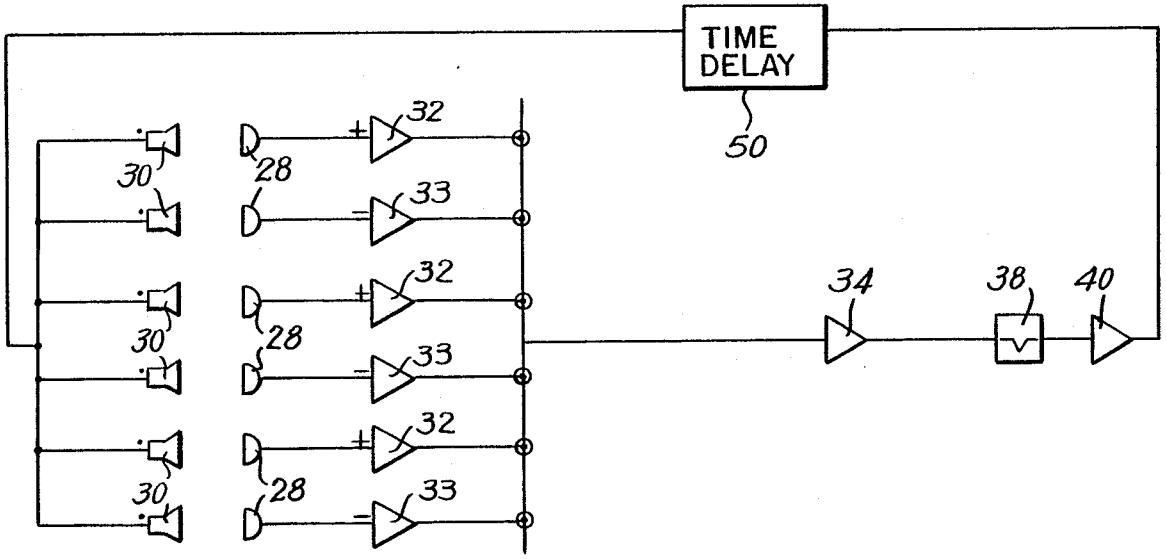
FIG. 3 is a schematic drawing of an acoustic sound system in accordance with the concept of FIG. 1.

FIG. 3 schematically illustrates the acoustic arrangements of FIG. 4. The circuit includes an even-numbered plurality of microphones 28 and an equal number of loudspeakers 30 physically positioned so that the output of the loudspeakers 30 is picked up by the microphones 28. The circuit also includes a pre-amplifier 32, 33 receiving the microphone input. Outputs of the amplifiers 32 are 180° out of phase from outputs of the amplifiers 33.

The signal outputs from the amplifiers 32, 33 are fed into a summing amplifier 34. The output of the summing amplifier 34 is fed through a notch filter which reduces undesirable feedback by eliminating narrow specific frequencies as is well known in the art. The notch filter is not a novel portion of this invention and accordingly, is not described in further detail herein.

The output of the filter 38 is inputted to an amplifier 40 which drives all of the loudspeakers 30 equally and in phase. Because the common signals from the loudspeakers 30 to the microphones 28 are cancelled out in the summing circuit, and all of the microphones and loudspeakers are simultaneously active, a person at any position at the table is free to speak at any time without need for switching. Every person at the table receives a signal of equal amplitude from the loudspeaker regardless of the distance from the person who is actually speaking.

It should be understood, that other acoustic techniques can be used in conjunction with the acoustic sound system described above. For example, a time delay, shown as 50 in FIG. 3, can be provided selectively to the loudspeakers so that the electronically delivered sound arrives in a desired relationship with the arriving sound pressure waves produced by the speaking person.

Figure 5:
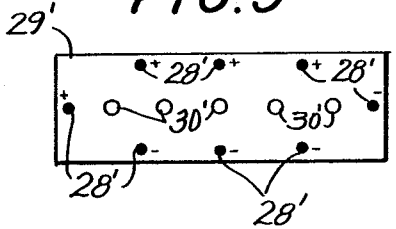
FIG. 5 is a view similar to FIG. 4 showing an alternative arrangement of microphones and loudspeakers in accordance with the invention.

In the description above, an even number of microphones is always included and an equal number of loudspeakers is provided, one loudspeaker particularly associated with one microphone. FIG. 5 illustrates an alternative exemplary arrangement of loudspeakers and microphones in accordance with the invention wherein the number of loudspeakers is less than the number of microphones. Microphones for producing out-of-phase signals are opposed to each other across the width or length of the table 29' and loudspeakers 30' have a symmetrical relationship with reference to each microphone such that opposed microphones receive the same cumulative amplitude of input signal from the loudspeakers. As in the previously descried embodiment, there must be an even number of microphones, but the number of loudspeakers is less than the number of microphones and may be an even or odd number. The loudspeaker outputs are in phase and the loudspeaker inputs to the microphones are cancelled in the summing circuit as described above.

It should be understood with reference to the embodiments FIGS. 4 and 5 and the circuit of FIG. 3, that the number of loudspeakers and microphones can be increased or reduced so long as such modifications are accomplished with consideration for the acoustic relationships of the opposed pairs of microphones. Two microphones can be added or removed, and so forth until either the configuration of FIG. 1, including only two modular units is achieved, or in theory at least, until an infinite number of microphones is employed. As the number of opposed microphone pairs is increased, the number and positioning of loudspeakers is modified to assure equal inputs to the opposed microphone pairs. An acoustic sound system in accordance with the invention can include a single loudspeaker outputting signals to a plurality of opposed microphone pairs.

It should be understood that out-of-phase signals from the phase shifters 14, 18 can be inputted directly and simultaneously to the amplifier 22 with the same cancellation of equal but out-of-phase signals.

In this system a microphone signal from its adjacent loudspeaker is deliberately reproduced because it is necessary that that microphone's contribution appear in the sum. Only one signal processing channel, and therefore one time delay, one filter, etc., is required. Also there is greater flexibility in the placement of microphones. It is only necessary that each microphone be counter-balanced somewhere else in the system. It is the creation of a common sum that makes this possible.

In an alternative embodiment in accordance with the invention, (FIG. 6), two-way telephone communication can be incorporated, so that a person may participate in a conference by telephone with the same freedom of access to the conversations in sending and receiving, as is available for those present at the conference table. Two separate similar-systems in separate rooms can communicate by telephone nationwide. The common sum always insures that long line echos, caused by open microphones and speakers in each room, can be suppressed.

Figure 6:
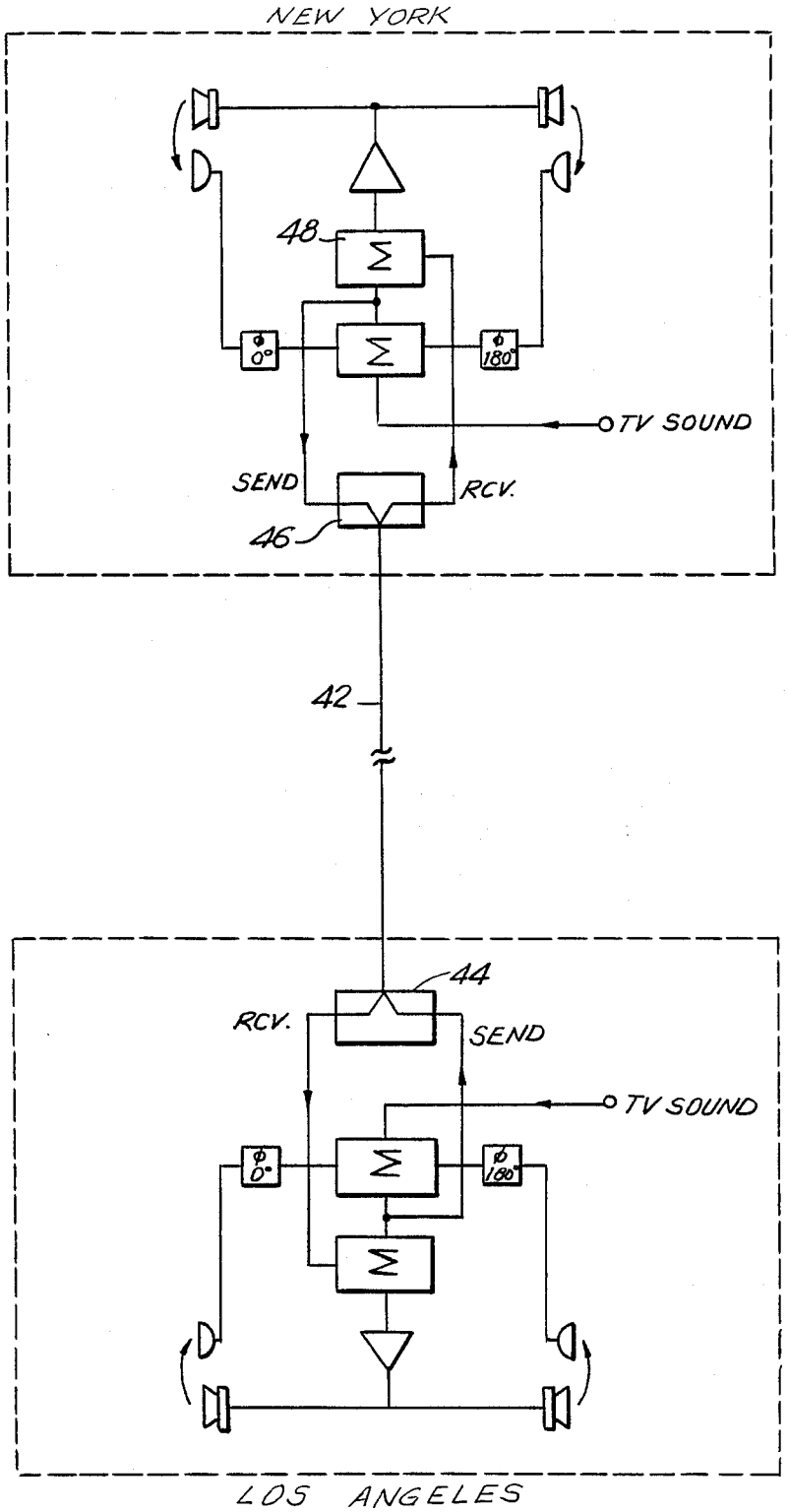
FIG. 6 is a diagram of a long-distance conferencing network using circuitry in accordance with the invention.

FIG. 6 illustrates an exemplary long distance interconnection between two systems, one in New York and one in Los Angeles. The systems which are substantially similar to that illustrated in FIG. 1 are connected together by the conventional long distance telephone line 42 by means of a standard hybrid 44 which allows for sending and receiving in the known manner. For sending from the Los Angeles location to the New York location, the summed signal is inputted to the send terminal of the hybrid 44 and then by way of the line 42 to the hybrid 46 where the received signal is inputted to a second summing network 48. Thus, the received signal is suppressed by the system and does not get sent back out across the line 42 to Los Angeles. Transmissions from New York to Los Angeles are effected in a similar manner.

In other alternative embodiments of an acoustic sound system in accordance with the invention, modular units comprising a microphone and a loudspeaker paired with another microphone and loudspeaker unit may be used, for example, in a bankteller's window or a ticket seller's window where one module is inside the window and the other module is outside the window. A free conversation can be readily carried out between the parties on both sides of the window without use of hands or other switching. Also, the acoustic sound system in accordance with the invention can be used in an office intercom system. Recorded music or TV sound can be input at one location in any of the above embodiments and be heard on all speakers. Two systems can be installed in any application to provide stereo communications.

Also, in an alternative embodiment of an acoustic sound system in accordance with the invention, the quantity of microphones need not be an even number so long as the net effect at the summing circuit due to speaker-to-microphone inputs is a cancellation. For example, in such an embodiment selected levels of amplification may be applied to different microphone signals so as to produce cancellation. Such uneven amplification would carry through the circuits and affect the output of desired speech in that the level of loudspeaker output would vary depending up which microphone is spoken into. However, in accordance with the invention, two-way hands-free conversations are provided, and there are applications where a stronger output may be desirable from selected microphone inputs. For example, the corporate president may be heard above the vice-presidents.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language might be said to fall therebetween.

What is claimed is:

1. An acoustic sound system for a room, comprising:

pairs of modules in the room, each pair including a first module with a first microphone and an associated first loudspeaker and a second module with a second microphone and an associated second loudspeaker, each first microphone and first loudspeaker, and each second microphone and second loudspeaker, having a substantially similar acoustic relationship, microphone relative to loudspeaker, substantially equal level sound signals incident on each microphone causing outputs of a substantially equal level signal from each loudspeaker;

phase shifting means for shifting by about 180° the phase of either the output of each second microphone or the input of each second loudspeaker; and central summing means for receiving the outputs of the first and second microphones from each of the pairs of modules and summing the outputs to produce a single summed output signal, the single summed output signal being coupled to the input of each first and second loudspeaker;

whereby sound input to a microphone from external the system is output from each of the loudspeakers and sound input to a microphone from one of the loudspeakers is substantially cancelled.

2. The acoustic sound system of claim 1 further comprising amplifier means electrically coupled between the summing means and the loudspeakers for amplifying the summed output signal.

3. The acoustic sound system of claim 1 wherein the output of each of said microphones associated with the second modules are shifted 180° out of phase with the output of each of said microphones associated with the first modules with like input, the loudspeakers associated with both the first and second modules outputting signals of like phase with like input.

4. The acoustic sound system of claim 1 wherein the output of the loudspeaker associated with each second module is shifted 180° out of phase with the output of the speaker associated with the first module with like input, the microphones associated with both of the first and second modules having in phase outputs with like inputs.

5. The acoustic sound system of claim 1 further comprising filter means electrically coupled between said summing means and said loudspeakers.

6. The acoustic sound system of claim 2 further comprising filter means electrically coupled between said summing means and said amplifier means.

7. The acoustic sound system of claim 1 further comprising time delay means for driving said loudspeakers with a time delay.

8. The acoustic sound system of claim 3 further comprising amplifier means electrically coupled between the summing means and the loudspeakers for amplifying the summed output signal.

9. The acoustic sound system of claim 4 further comprising amplifier means electrically coupled between the summing means and the loudspeakers for amplifying the summed output signal.

10. The acoustic sound system of claim 7 wherein the summing means includes a summing amplifier.

11. The acoustic sound system of claim 1 wherein the phase shifting means includes an inverting amplifier.

12. The acoustic sound system of claim 1 wherein the associated microphones and loudspeakers of the first and second modules have a substantially fixed acoustic and spatial relationship.

* * * * *